US012345425B2

(12) United States Patent
Fox et al.

(10) Patent No.: US 12,345,425 B2
(45) Date of Patent: Jul. 1, 2025

(54) METHOD OF IMPROVING AIR COOLED PACKAGED UNITS PERFORMANCE FOR MULTI-PACKAGED-UNITS INSTALLATIONS

(71) Applicant: TRANE INTERNATIONAL INC., Davidson, NC (US)

(72) Inventors: William B. Fox, Onalaska, WI (US); Gang Wang, Holmen, WI (US); John S. Hausmann, La Crosse, WI (US); Wei Wei Liang Sun, Shanghai (CN)

(73) Assignee: TRANE INTERNATIONAL INC., Davidson, NC (US)

( * ) Notice: Subject to any disclaimer, the term of this patent is extended or adjusted under 35 U.S.C. 154(b) by 304 days.

(21) Appl. No.: 17/818,552

(22) Filed: Aug. 9, 2022

(65) Prior Publication Data

US 2023/0314021 A1 Oct. 5, 2023

(30) Foreign Application Priority Data

Mar. 31, 2022 (CN) ..... 202210345256.0

(51) Int. Cl.

| | |
|---|---|
| ***F24F 11/64*** | (2018.01) |
| ***F24F 11/30*** | (2018.01) |
| ***F24F 11/77*** | (2018.01) |
| *F24F 110/12* | (2018.01) |
| *F24F 110/32* | (2018.01) |

(52) U.S. Cl.

CPC ..... *F24F 11/30* (2018.01); *F24F 11/64* (2018.01); *F24F 11/77* (2018.01); *F24F 2110/12* (2018.01); *F24F 2110/32* (2018.01)

(58) Field of Classification Search

CPC .. F24F 11/30; F24F 11/64; F24F 11/77; F24F 2110/12; F24F 2110/32

See application file for complete search history.

(56) References Cited

U.S. PATENT DOCUMENTS

2012/0267086 A1* 10/2012 Yanik ..... F28F 9/0282 165/174

2021/0034024 A1 2/2021 Patel et al.

FOREIGN PATENT DOCUMENTS

| | | | |
|---|---|---|---|
| JP | 2021067429 A | * | 4/2021 |
| WO | 2012/062442 A2 | | 5/2018 |
| WO | 2019/043834 A1 | | 3/2019 |

OTHER PUBLICATIONS

Extended European Search Report, European Patent Application No. 23165942.6, Aug. 16, 2023 (7 pages).

* cited by examiner

*Primary Examiner* — Michael W Choi

(74) *Attorney, Agent, or Firm* — HSML P.C.

(57) ABSTRACT

A heating, ventilation, air conditioning, and refrigeration (HVACR) system includes an array of packaged units; and a controller to obtain an operating condition of the array of packaged units, derive the operating condition to construct an operating pattern, select one or more packaged units to be adjusted to increase efficiency of the array of packaged units based on the operating pattern, and to adjust operation of the one or more packaged units selected by the controller.

20 Claims, 8 Drawing Sheets

METHOD OF IMPROVING AIR COOLED PACKAGED UNITS PERFORMANCE FOR MULTI-PACKAGED-UNITS INSTALLATIONS

FIELD

This disclosure relates generally to a heating, ventilation, air conditioning, and refrigeration (HVACR) system having an array of packaged units to condition a space. More specifically, the disclosure relates to controls and methods for adjusting the operation of one or more packaged units of the array of the packaged units to improve performance and efficiency and to reduce energy consumption of the array in conditioning the space.

BACKGROUND

A heating, ventilation, air conditioning, and refrigeration (HVACR) system may include a group of rooftop units installed on the rooftop of a building. The rooftop units can include one or more heat exchangers to facilitate thermal energy exchange between a heat transfer fluid and the outdoor air. The heat transfer fluid can be part of a fluid circuit to condition indoor air. A fan can move the conditioned indoor air in an air distribution system to condition the entire building. The group of rooftop units can change the temperature profile of the outdoor air over the group. For example, in a cooling operating where the rooftop units release heat into outdoor air, the upstream rooftop units in the group can exhaust heat into the outdoor air, heating up the intake temperature of a downstream rooftop unit in the same group and decreasing the efficiency of the downstream rooftop unit.

SUMMARY

This disclosure relates generally to a heating, ventilation, air conditioning, and refrigeration (HVACR) system having an array of packaged units (e.g., air cooled chillers, direct free cooling chillers, air handling units, air conditioning outdoor units, heat pumps, air-cooled condensers or condenser coils, or the like) to condition a space. More specifically, the disclosure relates to controls and methods for adjusting the operation of one or more packaged units of the array of the packaged units to improve performance and efficiency and to reduce energy consumption of the array in conditioning the space.

The array of packaged units exchanges thermal energy with an ambient fluid in the environment. For example, when providing cooling to the conditioned space, the array of packaged units can exhaust heat to the ambient fluid, such as air flowed by the wind in the environment. Upstream units can be some packaged units of the array disposed upstream from some other packaged units of the array relative to a flow direction of the ambient fluid (e.g., wind direction). Downstream units can be some packaged units of the array disposed downstream from some other packaged units of the array relative to the flow direction of the ambient fluid.

The ambient fluid flows through the upstream units and can remove heat from the upstream units. The heat can increase the temperature of the ambient fluid exhausted from the upstream units, heating the ambient fluid flows to some of the downstream units.

Generally, packaged units can operate most efficiently when receiving ambient fluid at a temperature within a desired temperature range. When the downstream units receive ambient fluid above this temperature range (e.g., heated by the upstream units), the downstream units are susceptible to operating less efficiently, consuming more energy, and lowering the overall efficiency of the array. Accordingly, by adjusting the operation (e.g., turning off, shutting down, or the like) of some of the packaged units such that the temperature of the ambient fluid received by the downstream units is lowered, the overall efficiency of the array can be improved. For example, adjusting the operation of the packaged units can include increasing the operating load, decreasing the operating load, turning on, turning off, turning partially off, or the like.

It is appreciated that an array of packaged units providing heating, cooling, dehumidification, or the like, or a combination thereof, can benefit from adjusting the operation of one or more packaged units within the array to regulate the ambient fluid received by the downstream units. For example, when providing heating to the conditioned space, the array of packaged units can absorb heat from the ambient fluid. Upstream units absorbing heat can cool the ambient fluid received by downstream units to a temperature lower than the temperature range efficient for the packaged units. Accordingly, by adjusting or turning off some packaged units such that the temperature of the ambient fluid received by the downstream units is increased into the temperature range, the overall efficiency of the array can be improved.

In some embodiments, a heating, ventilation, air conditioning, and refrigeration (HVACR) system, includes an array of packaged units; and a controller configured to obtain an operating condition of the array of packaged units, derive the operating condition to construct an operating pattern, select one or more packaged units to be adjusted to increase efficiency of the array of packaged units based on the operating pattern, and to adjust operation of the one or more packaged units selected by the controller.

In some embodiments, a method of operating a HVACR system includes obtaining an operating condition of an array of packaged units; deriving the operating condition to construct an operating pattern; selecting one or more packaged units in the array of packaged units to be adjusted to increase efficiency based on the operating pattern; and adjusting operation of the one or more packaged units selected by the controller.

BRIEF DESCRIPTION OF THE DRAWINGS

References are made to the accompanying drawings that form a part of this disclosure and which illustrate the embodiments in which systems and methods described in this specification can be practiced.

Like reference numbers represent like parts throughout.

DETAILED DESCRIPTION

Figure 1:
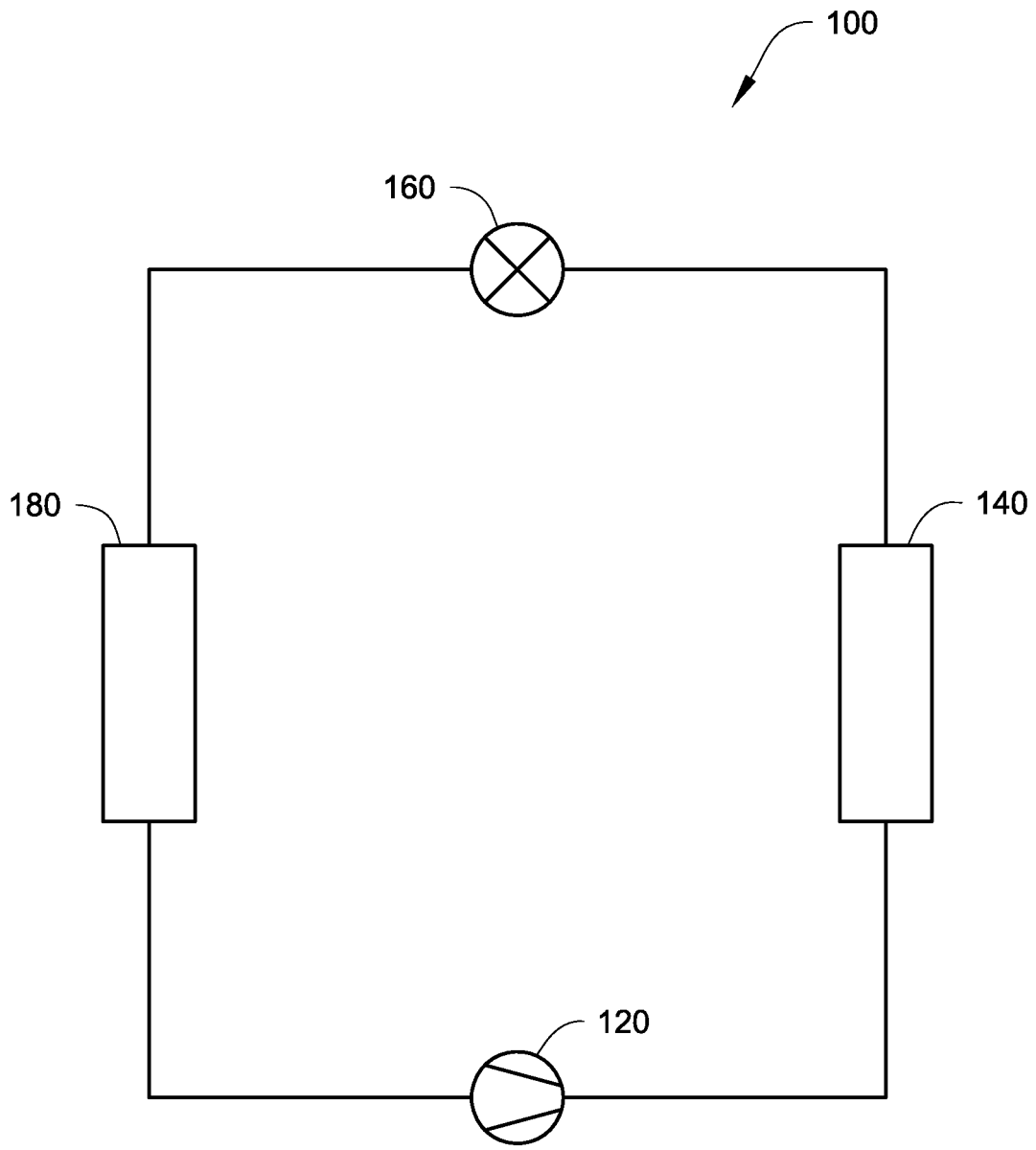
FIG. 1 illustrates a schematic diagram of a refrigeration circuit, which may be implemented in an HVACR system, according to an embodiment.

In the following detailed description, reference is made to the accompanying drawings, which form a part of the description. In the drawings, similar symbols typically identify similar components, unless context dictates otherwise. Furthermore, unless otherwise noted, the description of each successive drawing may reference features from one or more of the previous drawings to provide clearer context and a more substantive explanation of the current example embodiment. Still, the example embodiments described in the detailed description, drawings, and claims are not intended to be limiting. Other embodiments may be utilized, and other changes may be made, without departing from the spirit or scope of the subject matter presented herein. It will be readily understood that the aspects of the present disclosure, as generally described herein and illustrated in the drawings, may be arranged, substituted, combined, separated, and designed in a wide variety of different configurations, all of which are explicitly contemplated herein.

Particular embodiments of the present disclosure are described herein with reference to the accompanying drawings; however, it is to be understood that the disclosed embodiments are merely examples of the disclosure, which may be embodied in various forms. Well-known functions or constructions are not described in detail to avoid obscuring the present disclosure in unnecessary detail. Therefore, specific structural and functional details disclosed herein are not to be interpreted as limiting, but merely as a basis for the claims and as a representative basis for teaching one skilled in the art to variously employ the present disclosure in virtually any appropriately detailed structure. In this description, as well as in the drawings, like-referenced numbers represent elements that may perform the same, similar, or equivalent functions.

Additionally, the present disclosure may be described herein in terms of functional block components and various processing steps. It should be appreciated that such functional blocks may be realized by any number of hardware and/or software components configured to perform the specified functions.

The scope of the disclosure should be determined by the appended claims and their legal equivalents, rather than by the examples given herein. For example, the steps recited in any method claims may be executed in any order and are not limited to the order presented in the claims. Moreover, no element is essential to the practice of the disclosure unless specifically described herein as "critical" or "essential."

In some embodiments, hot (or cold) air exhaust from operating packaged units (e.g., air cooled chillers) can recirculate and result in higher (or lower) than ambient temperatures at coil entering air surfaces, causing a decrease in capacity and efficiency, which may result in packaged units going off line due to high (or low) entering air temperatures. Such issues can correlate with the number of packaged units, packaged unit layout, customer features such as walls or separators, generators, prevailing (or actual) wind speed/velocity and/or direction, or the like. Embodiments disclosed herein can provide tuning of the packaged units staging (e.g., turning on or off selected packaged units) based on the above factors to optimize overall site packaged units performance. In particular, the tuning is beneficial if there is packaged units redundancy and/or the site load is not at maximum.

FIG. 1 is a schematic diagram of a refrigerant circuit 100, according to an embodiment. The refrigerant circuit 100 can include a compressor 120, a condenser 140, an expander 160, and an evaporator 180. The refrigerant circuit 100 may also include a controller (e.g., the controller 220 of FIG. 2) configured to control the operations of the compressor 120, the condenser 140, the expander 160, and/or the evaporator 180.

The refrigerant circuit 100 can generally be applied in a variety of systems used to control an environmental condition (e.g., temperature, humidity, air quality, or the like) in a conditioned space. The conditioned space can be a space within an office building, a commercial building, a factory, a laboratory, a data center, a residential building, or the like. In an embodiment, the refrigerant circuit 100 can be configured to be a cooling system (e.g., an air conditioning system) capable of operating in a cooling mode. In an embodiment, the refrigerant circuit 100 can be configured to be a heat pump that can operate in a heating/defrost mode. It is appreciated that the refrigerant circuit 100 can configured to operate in a cooling mode and a heating/defrosting mode, The compressor 120, the condenser 140, the expander 160, and the evaporator 180 can be fluidly connected. An "expander" as described herein may also be referred to as an expansion device. In an embodiment, the expander 160 can be an expansion valve, expansion plate, expansion vessel, orifice, or the like, or other such types of expansion mechanisms. It should be appreciated that the expander 160 may be any suitable type of expander used in the field for expanding a working fluid to cause the working fluid to decrease in pressure and temperature.

The refrigerant circuit 100 is an example and can be configured to include more or less components. For example, in an embodiment, the refrigerant circuit 100 can include other components such as, but not limited to, an economizer heat exchanger, one or more flow control devices (e.g., a valve, a pump, etc.), a receiver tank, a dryer, a suction-liquid heat exchanger, or the like.

The refrigerant circuit 100 can operate according to generally known principles. The refrigerant circuit 100 can be configured to heat and/or cool a liquid process fluid. The liquid process fluid can be a heat transfer fluid or medium (e.g., a liquid such as, but not limited to, water or the like). The refrigerant circuit 100 may be generally representative of a liquid chiller system. The refrigerant circuit 100 can alternatively be configured to heat and/or cool a gaseous process fluid (e.g., a heat transfer medium or fluid (e.g., a gas such as, but not limited to, air or the like), in which case the refrigerant circuit 100 may be generally representative of an air conditioner and/or heat pump.

In some embodiments, the refrigerant circuit 100 can operate as a vapor-compression circuit such that the compressor 120 compresses a working fluid (e.g., a heat transfer fluid such as, but not limited to, refrigerant or the like) from a relatively lower pressure gas to a relatively higher-pressure gas. The relatively higher-pressure gas is at a relatively higher temperature, being discharged from the compressor 120 and flowing through the condenser 140. In accordance with generally known principles, the working fluid flows through the condenser 140 and rejects heat to the process fluid (e.g., water, air, etc.), thereby cooling the working fluid. The cooled working fluid, which is now in a liquid form, flows to the expander 160 that can reduce the pressure of the working fluid. As a result, a portion of the working fluid is converted to a gaseous form. The working fluid, which is now in a mixed liquid and gaseous form flows to the evaporator 180. The working fluid flows through the evaporator 180 and absorbs heat from the process fluid (e.g., a heat transfer medium such as, but not limited to, water, a solution, air, etc.), heating the working fluid, and converting it to a gaseous form. The gaseous working fluid then returns to the compressor 120. The above-described process continues while the heat transfer circuit is operating, for example, in a cooling mode (e.g., while the compressor 120 is enabled).

In some embodiments, the refrigerant circuit 100 can be configured to operate as a free cooling/heating circuit to control one or more environmental conditions of the conditioned space. A free cooling/heating circuit can include a first heat exchanger and a second heat exchanger fluidly connected by a working fluid. The first and second heat exchangers of the free cooling/heating circuit can be dedicated heat exchangers in addition to the refrigeration circuit 100 having the compressor 120, the condenser 140, the expander 160, and the evaporator 180. In some embodiments, the first and second heat exchangers can share, for example, the condenser 140 and the evaporator 180 such that the refrigeration circuit 100 can operate as a free cooling/heating circuit or a vapor compression circuit.

In some embodiments, the first heat exchanger can exchange thermal energy between a working fluid and an ambient fluid (e.g., outdoor air). The first exchanger can be disposed in a location suitable to exchange thermal energy with the ambient fluid. The location can include a rooftop of the conditioned space. The second heat exchanger can be the evaporator 180 to exchange thermal energy between the working fluid and fluid in the conditioned space. Fluid in the conditioned space can, for example, be indoor air. In some embodiments, the first heat exchanger can be the condenser 140.

In a cooling operation, the first heat exchanger can release thermal energy to the ambient fluid and cool the working fluid. A pump can move the cooled working fluid to the second heat exchanger to exchange thermal energy with the fluid in the conditioned space, heating the working fluid to be cooled by the ambient fluid again. In some embodiments, in a cooling operation, the ambient fluid can have a temperature lower than the temperature of the fluid in the conditioned space. In a heating operating, the pump can circulate the working fluid between the first and the second heat exchangers to move thermal energy from the ambient fluid to the fluid in the conditioned space. In some embodiments, in a heating operation, the ambient fluid can have a temperature higher than the temperature of the fluid in the conditioned space. The working fluid can be any heat transfer fluid such as a refrigerant, water, a water solution, glycol fluid, or the like.

Figure 2:
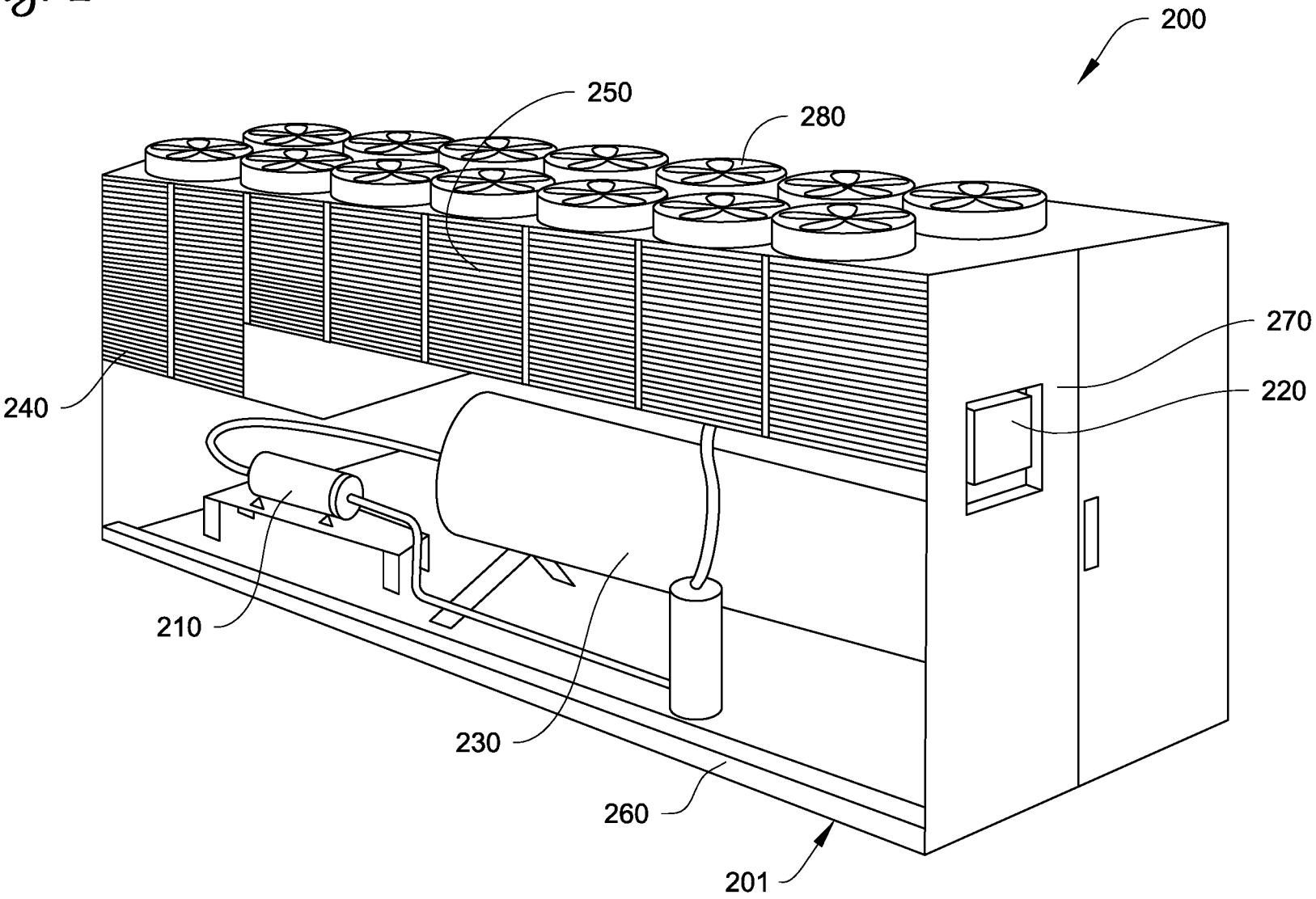
FIG. 2 is a schematic view of a packaged unit, according to an embodiment.

FIG. 2 is a schematic view of a packaged unit 200, according to an embodiment. The packaged unit 200 can be any piece of HVACR equipment that exchanges thermal energy with the environment, for example, by absorbing or releasing thermal energy with an ambient fluid (e.g., outdoor air). The packaged unit 200 can include at least a portion of a fluid circuit to transfer thermal energy from the packaged unit 200 to the conditioned space. In some embodiments, the fluid circuit can be a heat transfer circuit (such as, for example, as shown in FIG. 1) that is configured to be a free cooling/heating circuit, a vapor-compression circuit, or the like, or a combination thereof. In an embodiment, the packaged unit 200 of FIG. 2 can be an air cooled chiller, a free cooling chiller (e.g., a direct free cooling chiller), an air handling unit, an air conditioning outdoor unit, a heat pump, an air-cooled condenser or condenser coil, or the like.

The air cooled chiller can include at least one heat exchanger disposed therein. The heat exchanger facilitates heat exchanging between air and a fluid circuit. The circuit can be a free heating/cooling circuit or a vapor-compression circuit to provide environmental control to a controlled space. In some embodiments, the air cooled chiller can include a free cooling circuit configured to cool the condenser in a vapor-compression circuit. The free cooling circuit can include a liquid-air heat exchanger to cool the condenser.

The air handling unit can include a fan or blower to move conditioned air through an air distribution system to condition the conditioned space. The air handling unit can include an air outlet that can release air into the environment. For example, the air outlet can be an outlet of a heat exchanger configured to condense a working fluid, releasing an exhaust that is heated above the ambient temperature.

The air conditioning outdoor unit can include a condenser configured to condense a refrigerant in a fluid circuit. A fan of the air conditioning outdoor unit can force the ambient fluid, such as outdoor air, through the condenser to remove thermal energy from the condenser. The air conditioning outdoor unit can be fluidly connected with an evaporator, an expander, and a compressor to form the fluid circuit. The fluid circuit can include a vapor-compression circuit. It is appreciated that the evaporator, the expander, and/or the compressor may or may not be contained within the same housing of the air conditioning outdoor unit. In some embodiments, the heat pump can include an evaporator configured to evaporate a refrigerant fluidly connecting a condenser, a compressor, and an expander with the evaporator in a refrigeration circuit.

The heat pump can include an evaporator configured to evaporate a refrigerant in a fluid circuit. A fan of the heat pump can force the ambient fluid, such as outdoor air, through the evaporator to provide thermal energy to evaporate the refrigerant. The heat pump can be fluidly connected with a condenser, an expander, and a compressor to form the fluid circuit. The fluid circuit can include a vapor-compression circuit. It is appreciated that the condenser, the expander, and/or the compressor may or may not be contained within the same housing of the heat pump.

The packaged unit 200 can include a housing (or enclosure) 201 configured to contain one or more HVACR system equipment, such as the compressor 120, the condenser 140, the expander 160, and the evaporator 180 of the refrigeration circuit 100 of FIG. 1.

As shown in FIG. 2, the housing 201 of the packaged unit 200 can contain a compressor 210, an evaporator 230, a condenser 240, a controller 220, and one or more panels 270. The condenser 240 is connected to an air coil 250 and one or more fans 280. In an embodiment, the compressor 210 can be a fixed speed or variable speed compressor to compress a working fluid. The fans 280 can be single speed or variable speed and/or fans with a multiple number of fan stages or discrete steps to move air, for example, through the air coil 250. The panels 270 can be configured to be removable to provide access to the housing 201.

The condenser 240 and its air coil 250 in the embodiment shown are one example of an air cooled condenser, however, it will be appreciated that the specific condenser 240/coil 250 combination shown is merely exemplary.

The packaged unit 200 can be considered as a single unit within the HVAC system and be supported by a frame 260. It will be appreciated that the specific configuration shown in FIG. 2 is merely exemplary, as other packaged designs, layouts, and specific configurations may be employed.

It will be appreciated that the controller 220 can include a processor (not shown), a memory (not shown), and optionally a clock (not shown) and an input/output (I/O) interface (not shown). The controller 220 can be configured to receive data as input from various components within the HVACR system, such as the components shown in FIG. 1 and FIG. 2, and can also send command or control signals as output to various components within of the HVACR system. For example, controller 220 can be a central controller in communication with one or more of the packaged units 200 in the array 300, and can be configured to control the operation of one or more of the packaged units 200. The controller 220 can be configured to communicate with or control the packaged units 200 or other components in the system utilizing any suitable communications including power line communications, Pulse Width Modulation (PWM) communications, Local Interconnect Network (LIN) communications, Controller Area Network (CAN) communications, or the like. The communications can include wired and/or wireless, analog and/or digital communications. In one embodiment, the communication can include communications over telematics.

Figure 3A:
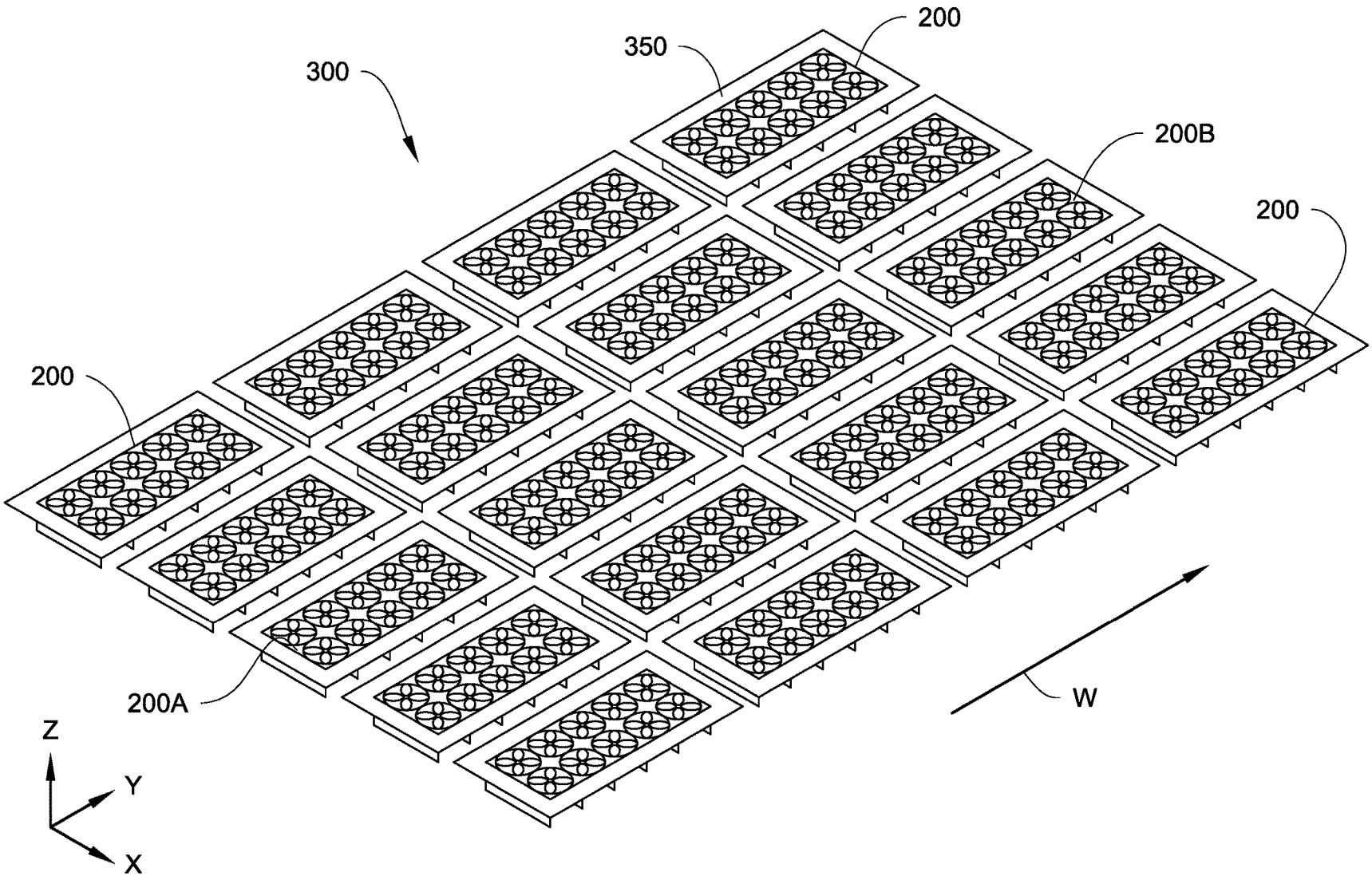
FIG. 3A is a perspective view of an array of packaged units, according to an embodiment.

FIG. 3A is a perspective view of an array 300 of packaged units 200, according to an embodiment. The array 300 can include one or more packaged units 200 arranged in a pattern. As illustrated, the array 300 can include twenty packaged units 200 arranged in a pattern of a 4 by 5 rectangular grid. It is appreciated that the packaged units 200 can be arranged in any suitable pattern as, for example, but not limited to, a grid, a circle, irregular, or a combination thereof. It is appreciated that the size of the array 300 can include any number of the same or different packaged units 200. For example, all the packaged units 200 of the array 300 can each have a full operating load of a first heating or cooling capacity. A full operating load can be the maximum output of the packaged unit 200 as designed by the manufacture of the packaged unit 200. In some embodiments, some of the packaged units 200 of the array 300 can have a full operating load larger, equal to, or smaller than the first heating or cooling capacity. In some embodiments, one or more of the packaged units 200 can operate in full or partial load of the full operating load. Operating under a partial load can be caused by a controller (e.g., controller 220) or inefficiencies due to, for example, ambient temperature being outside a temperature range most efficient for the packaged unit.

The array 300 of packaged units 200 can provide a conditioning load larger than a single packaged unit 200, for example, for a conditioned space requires a larger conditioning load.

It is appreciated that the exhaust of some of the packaged units 200 in the array 300 can affect the operating condition of some other of the packaged units 200 in the array 300. In some embodiments, the ambient fluid can flow in a direction W. The ambient fluid can be outdoor air flowed by the wind. Affecting the operating condition can include, for example, increasing or reducing an ambient temperature above or below a temperature range efficient for the packaged units 200.

Upstream units 200A and downstream units 200B can include one or more packaged units 200 disposed relative to the wind direction W. Upstream units 200A can create an exhaust that affect the ambient fluid. The exhaust can affect the ambient fluid, for example, by changing the ambient temperature of the ambient fluid at some locations (e.g., locations 510, 610, and 710 of FIGS. 5-7) over the array 300. For example, in a cooling mode, the upstream units 200A can create an exhaust that heats the ambient fluid at a location over the downstream units 200B. The downstream units 200B can receive the ambient fluid heated by the upstream units 200A. As a result, the downstream units 200B can operating at a lowered efficiency because of the ambient temperature of the ambient fluid provided to the downstream units 200B are outside the temperature range of which the packaged units 200 can operate most efficiently.

One or more of the packaged units 200 can optionally include a separator 350. In an embodiment, the separator 350 can be a baffle, a plate, or the like. The separator 350 can be configured to eliminate or reduce hot/cold air (e.g., hot/cold discharge air) recirculation of the packaged unit 200 (e.g., at the chiller condenser coil air inlet surfaces, into the chiller condenser coil inlets, or the like).

Figure 3B:
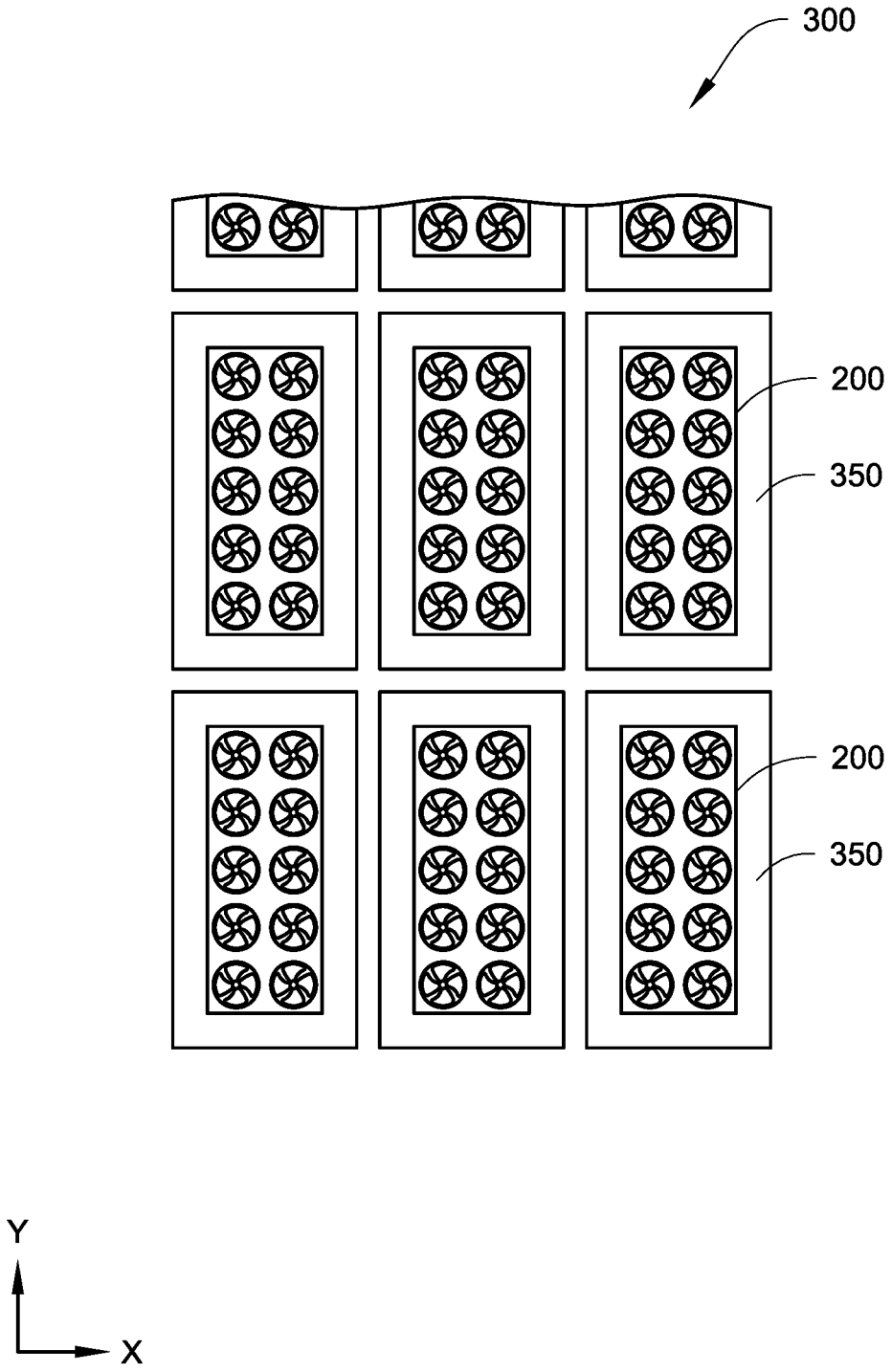
FIG. 3B is a top view of a portion of the array of FIG. 3A, according to an embodiment.

FIG. 3B is a top view of a portion of the array 300 of FIG. 3A, according to an embodiment. As shown in FIGS. 3A and 3B, each packaged unit 200 can include a separator 350. In an embodiment, the separator 350 can have a rectangular shape or any other suitable shape(s) or geometry. The separator 350 includes an opening to accommodate the packaged unit 200 within the separator 350.

In an embodiment, the separator 350 can have flat surface(s) extending horizontally. In the application where the packaged unit 200 is a chiller (e.g., an air-cooled chiller or the like), the separator 350 can be disposed at the level of the fan (e.g., 280 of FIG. 2) deck on a top portion of the chiller. That is, a height of the separator 350 and a height of the fan deck of the chiller are the same or almost the same. In such an embodiment, the fans 280 are disposed above the separator 350 and the rest of the chiller is below the separator 350. It will be appreciated that the separator 350 can be disposed at any suitable location.

In an embodiment, the separator 350 can have through holes (not shown) and have a desired amount of porosity to e.g., prevent rain, snow, or the like from accumulating on the separator 350. In another embodiment, the separator 350 do not have through holes. In such an embodiment, open space(s) can be provided between the separators 350 (see FIGS. 3A and 3B) to e.g., prevent rain, snow, or the like from accumulating on the separator 350.

As shown in FIGS. 3A and 3B, a distance between the openings of adjacent separators 350 or a distance between adjacent packaged units 200 in the Y direction (e.g., a width direction "W" of the array 300) can be at or about 12 feet. A distance between the openings of adjacent separators 350 or a distance between adjacent packaged units 200 in the X direction (e.g., a length direction of the array 300) can be at or about 12 feet. It will be appreciated that the Z direction is the height direction of the array 300. A distance between the opening of the separator 350 and an edge of the separator 350 or a distance between the packaged unit 200 and an edge of the separator 350 in the Y direction can be at or about 4 feet. A distance between the opening of the separator 350 and an edge of the separator 350 or a distance between the packaged unit 200 and an edge of the separator 350 in the X direction can be at or about 4 feet. It will be appreciated that the distance described herein can be any suitable distance.

In another embodiment, ducts can be placed on the outlets of each fan to mitigate air recirculation instead of using the separator 350. Such an embodiment might create excess pressure drop compared with the horizontal separator 350. In yet another embodiment, the space(s) between the packaged units 200 can be increased to a maximum allowable spacing to mitigate air recirculation instead of using the separator 350.

Figure 4:
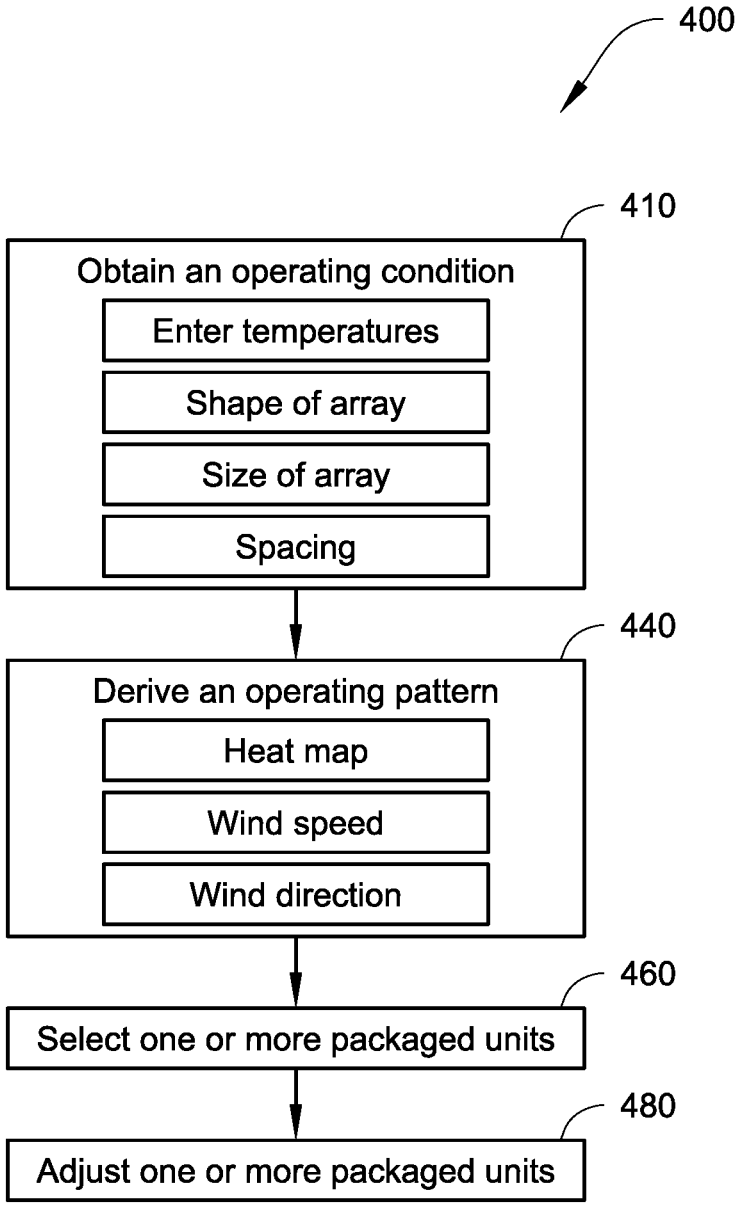
FIG. 4 shows a control method of the array of FIG. 3A, according to an embodiment.

FIG. 4 is a method (or an operational flow chart) 400 to control an array, such as for example the array 300 of FIG. 3A, according to an embodiment. The operational flow chart may include one or more operations, actions, or functions depicted by one or more blocks 410, 440, 460, and 480. Although illustrated as discrete blocks, various blocks may be divided into additional blocks, combined into fewer blocks, or eliminated, depending on the desired implementation. As a non-limiting example, the description of the method 400, corresponding to the depiction thereof in FIGS. 1-3 and 5-7 performed by the controller(s) described herein (e.g., 220 of FIG. 1) or any other suitable controller(s), according to one or more example embodiments described herein, pertains to operating a heating, ventilation, air conditioning, and refrigeration (HVACR) system. The method may begin at block 410.

Method 400 includes obtaining an operating condition of the array 300 of packaged units 200 at 410, deriving the operating condition to construct an operating pattern at 440, selecting one or more packaged units 200 in the array 300 to be adjusted to increase efficiency based on the operating pattern at 460; and adjusting the operation of the one or more packaged units selected by the controller at 480. In an embodiment, a controller (e.g., 220 of FIG. 2) is (or includes, or can be connected to) a specialized computer specifically configured to perform the methods disclosed herein.

At 410, a controller obtains an operating condition of the array 300 of packaged units 200. The operating condition can include an ambient temperature of one, more than one, or all of the packaged units 200 in the array 300. The controller can obtain the ambient temperature(s) with the corresponding location of the packaged unit 200 within the array 300.

In some embodiments, an entering temperature (e.g., entering water temperature or the like) and/or a coil temperature can be used to derive the ambient temperature or used as a proxy of the ambient temperature. The entering temperature can be obtained/determined in real-time (e.g., via a temperature sensor or the like) and can be the temperature of a fluid entering a heat exchanger (e.g., condenser 240 to condense the working fluid, a chiller, or the like) of a packaged unit 200 to exchange thermal energy with the working fluid.

In an embodiment, when a proxy of the ambient temperature is not available, sensors such as temperature sensors (for ambient temperature), wind speed sensors (e.g., airometer, anemometer, wind-gauge, or the like), wind direction sensors (e.g., wind vanes or the like) can be used to determine the ambient temperature, wind speed/velocity, and wind direction. It is appreciated that dedicated operating condition sensor(s) can be installed in the packaged units array (e.g., on one or more or all packaged units) to capture the operating condition (e.g., temperature, temperature distribution, wind speed/velocity, wind direction or the like) of the array. The operating condition sensor(s) can be one or more temperature sensors, wind speed sensors, wind direction sensors, flow sensor(s), or the like. The flow sensor(s) can measure the speed, the direction, or both of an ambient fluid flowing over the flow sensor(s). In some embodiments, the operating condition sensor(s) can be installed on one or more or all of the packaged units in the array or near the packaged units in the array (e.g., at a location between the packaged units, on the flooring of the rooftop, or the like).

In an embodiment, each packaged unit of the packaged units array can include a temperature sensor (e.g., to determine the ambient temperature), the temperature sensors form an array, and the ambient temperatures determined for the packaged units array can be used to estimate or model the wind speed/velocity and/or wind direction. In another embodiment, some packaged units of the packaged units array can include temperature sensors forming a temperature sensor grid, and the ambient temperatures determined for the packaged units can be used to estimate or model the wind speed/velocity and/or wind direction.

In yet another embodiment, in addition to one or more temperature sensors, one or more wind speed sensors and/or one or more wind direction sensors can be deployed to determine the wind speed/velocity and/or wind direction. For example, one temperature sensor, one wind speed sensor, and one wind direction sensor can be deployed to help determining the heat/cool map.

Depending on the entering temperatures on each packaged unit, the packaged unit can run on full load, partial load, variable speed, staging, on, or off, to meet the leaving temperature setpoint (e.g., leaving water temperature or the like) or requirement. In some embodiments, the fluid can be an ambient fluid, such as the air flowed by the wind through the array 300. In some embodiments, the entering temperature can be the temperature of a heat transfer fluid (e.g., water or water solution in a water chilling system). The heat transfer fluid can be used as a medium for the working fluid indirectly exchange thermal energy with the ambient fluid. Accordingly, the entering temperature can correlate with the ambient temperature of the ambient fluid. In some embodiments, the coil temperature can be the temperature of the coil (e.g., coil 250 of FIG. 2) that correlates with the ambient temperature of the ambient fluid (e.g., outdoor air).

In some embodiments, the operating condition can include the shape of the array 300, the size of the array 300, the orientation of the array 300, and/or the spacing between the packaged units 200. For example, the shape of the array 300 can be pattern such as a grid, a staggered arrangement, an irregular arraignment, or a combination thereof. The orientation of the array 300 can be a direction of the packaged unit relative the array 300. For examples, the packaged unit can have a rectangular housing. The long direction of the rectangular housing can be a first direction of the packaged unit. The array 300 can have a rectangular pattern. The longer direction of the rectangular pattern can be a second direction. The orientation of the array 300 can be the relative direction between the first direction and the second direction. For example, the orientation of the packaged unit is the same with the orientation of the array when the first and the second directions are the same direction. In an embodiment, the orientation of the array is relative to and can be determined based on e.g., the building and/or the prevailing or actual wind.

The size of the array 300 can be the number of the packaged units 200 in the array 300. The spacing can be a distance between adjacent packaged units 200, e.g., between separators 350.

In some embodiments, the controller 220 can include a power meter to obtain energy consumption of one or more of the packaged units 200 in the array 300. In some embodiments, the controller 220 can obtain the energy consumption (e.g., in kilowatts per hour) of a packaged unit 200 with its corresponding location within the array 300.

In some embodiments, the controller 220 can include an output monitor to obtain an operation or operating load (e.g., in tons, percentage of the maximum operating load, being on, being off, being partially off, or the like) of a packaged unit 200. In some embodiments, the controller 220 can obtain the operating load of a packaged unit 200 with its location within the array 300. The controller 220 can determine energy consumption (in the unit of Kw/ton) for chilling, via e.g., power monitors (e.g., to determine energy from the power grid or from diesel gensets). The controller 220 can also estimate or determine the power consumed by the packaged unit and/or how many tons of cooling capacities are generated at any given time.

In some embodiments, the controller 220 can obtain an operating mode of a packaged unit 200. An operating mode can include a heating mode, a cooling mode, a dehumidification mode, or the like. The heating mode can include the array 300 providing thermal energy into the conditioned space by absorbing thermal energy from the ambient fluid. The cooling mode can include the array 300 releasing thermal energy to the ambient fluid. The dehumidification mode can include the array 300 removing moisture in conditioned space by condensing water vapor from the conditioned space. In some embodiments, the controller 220 can obtain the operating mode of a packaged unit 200 with its location within the array 300.

In some embodiments, the controller 220 can obtain a load requirement (e.g., in tons) from the conditioned space. For example, the load requirement can be provided by temperature controller (e.g., a thermostat) in the conditioned space. Block 410 may be followed by block 440.

At 440, the controller 220 can derive the operating condition of the array 300 to construct an operating pattern. The operating pattern can include a heat map, a wind direction, and/or a wind speed, and/or the like.

For example, the controller 220 can construct a heat map by arranging the ambient temperature obtained from the packaged units 200 according to their locations within the array 300. The heat map can show the ambient temperatures local to the packaged units 200 in the array 300, providing the temperature distribution of the ambient temperature over the array 300.

In some embodiments, the controller 220 can derive a wind direction according to the operating condition. For example, in a cooling operation, the packaged units 200 heats the ambient fluid. The ambient temperature or the entering temperature increases in the direction of the airflow or the wind direction. The controller 220 can derive the wind direction from the direction of temperature increase.

In some embodiments, the controller 220 can derive a wind speed according to the operating condition. For example, in a cooling operation, the packaged units 200 heats the ambient fluid. The ambient temperature or the entering temperature increases more rapidly when the wind speed is slower and less rapidly when the wind speed is faster. Accordingly, the controller 220 can derive a wind speed from the rate of temperature increase. It is appreciated that one or more ambient fluid sensor(s) can measure ambient fluid (e.g., wind, air, or the like) velocity, speed, and/or direction, and allow the controller to capture the wind speed and/or direction directly from the ambient fluid sensor(s). Block 440 may be followed by block 460.

At 460, the controller 220 can determine or select one or more packaged units to be adjusted. The controller 220 can adjust the operation of the packaged units to turn on, off, or partially on or partially off one or more of the packaged units. For example, in a cooling operation, packaged units 200 can release heat into the ambient fluid. As the packaged units 200 being disposed in an array 300, a first packaged unit can heat the ambient fluid provide to a second packaged unit, increasing the ambient temperature and/or the entering temperature of the second packaged unit. Packaged units are generally optimized to operate most efficiently at a temperature within a temperature range. When the ambient fluid is heated by the first packaged unit above the temperature range, the second packaged unit can be operating less efficiently, consuming more energy. By adjusting the operation of the first packaged unit to lessen the heating of the ambient fluid provided to the second packaged unit, the ambient temperature of the second packaged unit can be lowered into the range where the second packaged unit can operate more efficiently. In some embodiment, when the first packaged unit is adjusted, for example, to lower the operating load, the efficiency regained by the second packaged unit can be compensated for reducing of output from the first packaged unit. In some embodiments, a third packaged unit, for example, being away from the first and/or the second packaged unit can be adjusted to provide more operating load to compensate for the reduced output from the first packaged unit. The third packaged unit can be a redundant packaged unit. It is appreciated that the array 300 can be configured to include one or more redundant packaged units.

The controller (e.g., 220 of FIG. 2) can determine or select one or more packaged units to be adjusted according to the operating pattern obtained or determined at 440. For example, a selection algorithm can, for example, be preprogramed into the controller 220 according to the heat map, the wind direction, and/or the wind speed. The algorithm can be determined, for example, by computational fluid dynamics analysis of varies patterns, sizes, and/or orientation of the array, wind direction and/or speed, ambient temperature, or the like. Simulations can, given an operating condition and/or an operating pattern, determine one or more packaged units to be turned on, turned off, or turned partially on or off. The simulation can determine the packaged units by optimizing for minimum energy consumption, for example, by lessening ambient temperature hot spot or cold spot in the heat map. In some embodiments, a hot spot can be the operating condition (e.g., ambient temperature) over a packaged unit being above a threshold level. For example, the threshold level can be a threshold temperature above which the packaged units will become less efficient. In some embodiments, a cold spot can be operating condition (e.g., ambient temperature) over a packaged unit being below a threshold level. For example, the threshold level can be a threshold temperature below which the packaged units (e.g., heat pump) will become less efficient. In some embodiments, the threshold can a predetermined value provided, for example, by the known design and manufacture of the packaged unit. In some embodiments, the threshold can be a variable correlated with the operating condition of the packaged unit(s) in the array. The selection rules can be saved in the controller such that, when the same operating condition and/or operating pattern is detected in operating, the controller can select the one or more packaged unit to be adjusted. Then, the controller can adjust the one or more packaged unit selected based on the operating condition and/or the operating pattern.

It is appreciated that the algorithm can be predetermined according to the simulations. An algorithm being predetermined can select and adjust the packaged units to conserve energy without requiring computational fluid dynamics analysis onsite and/or in real-time. In some embodiments, the algorithm can be determined, for example, by computational fluid dynamics analysis, onsite and/or in real-time to optimize energy consumption.

Figure 5:
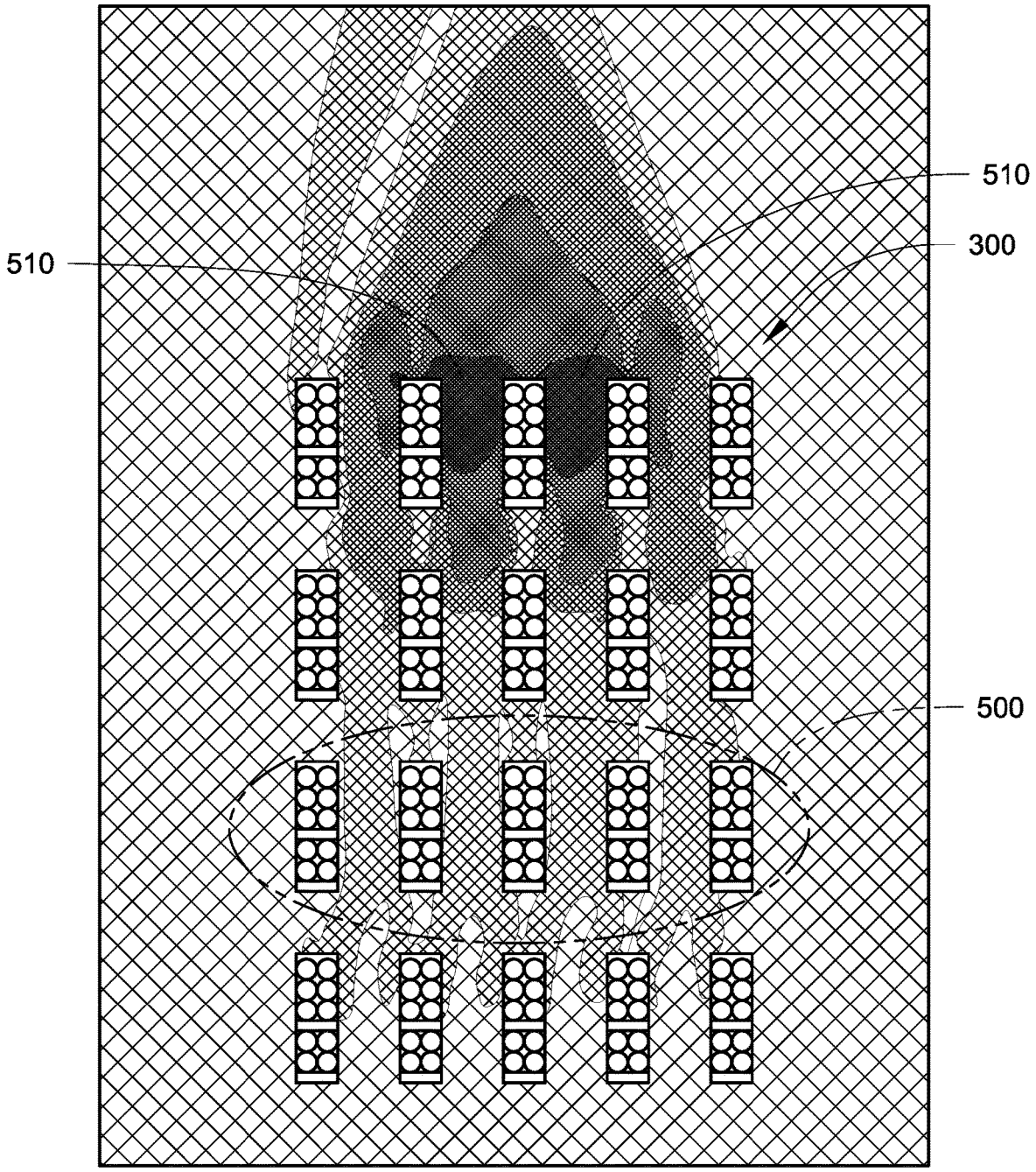
FIG. 5 shows a computational fluid dynamics diagram of the array of FIG. 3A, according to an embodiment.
Figure 6:
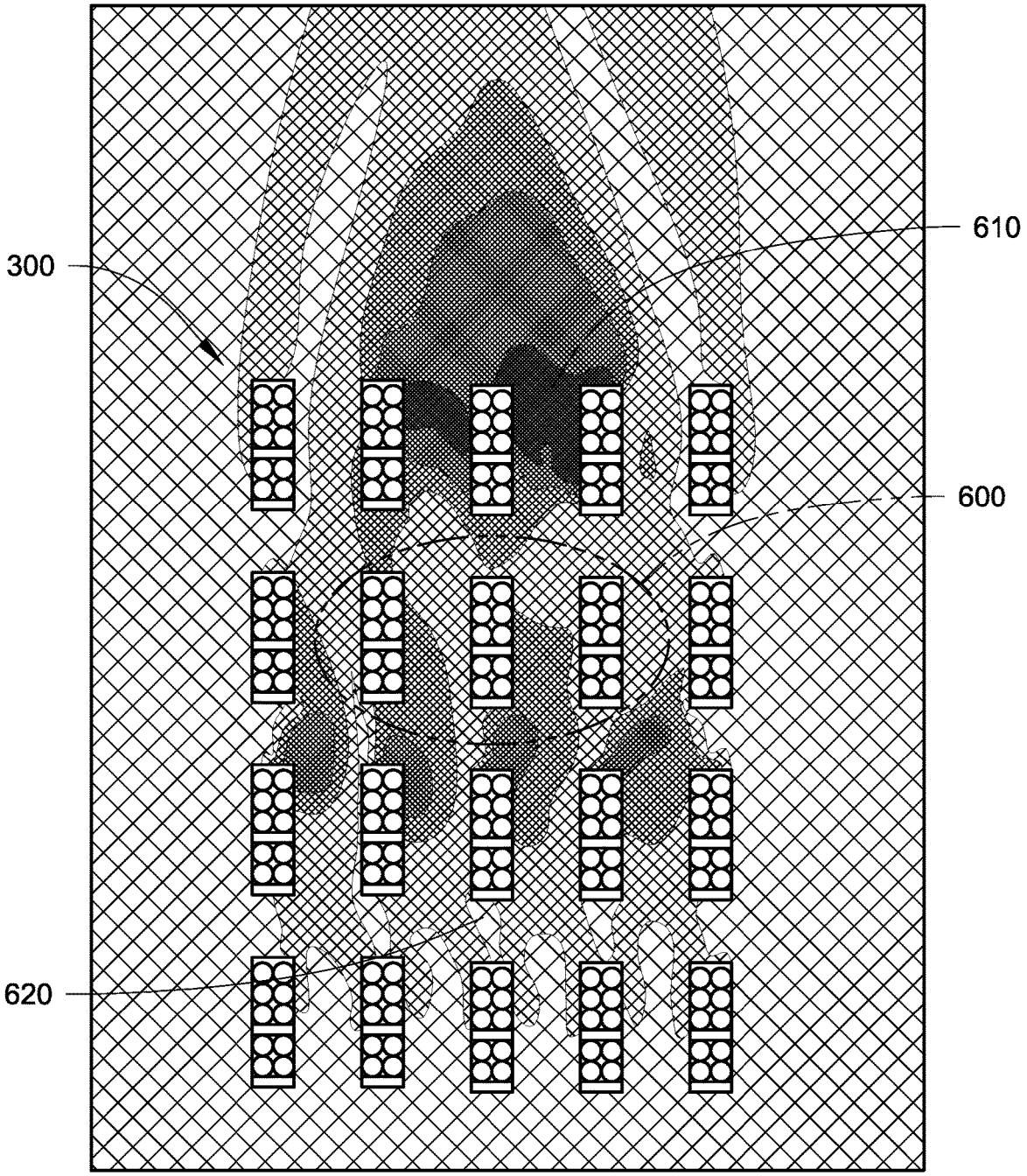
FIG. 6 shows a computational fluid dynamics diagram of the array of FIG. 3A, according to another embodiment.
Figure 7:
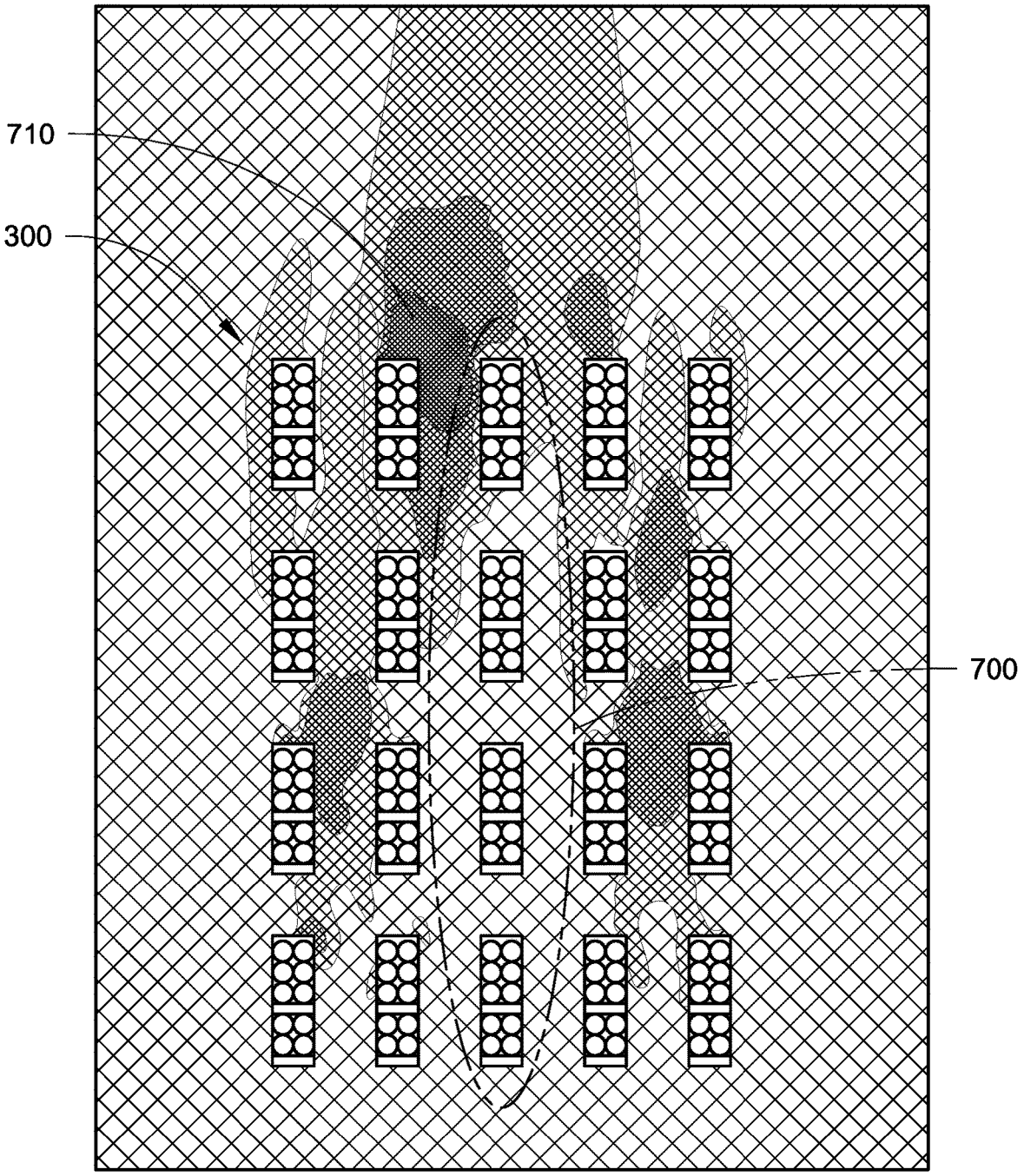
FIG. 7 shows a computational fluid dynamics diagram of the array of FIG. 3A, according to yet another embodiment.

FIGS. 5-7 show computational fluid dynamics diagrams (CFDs) of the array 300 of FIG. 3A with prevailing or actual winds, according to some embodiments. It will be appreciated that CFD simulation can be used to provide guidance on array 300 installations with a large number of packaged units. For example, the installation can be at a data center, on the roof of or around a building, and near heat sources (e.g., genset or the like). In some embodiments, the large number of packaged units can be, for example, over one hundred packaged units, over one hundred and eighty packaged units, over three hundred packaged units, or the like. In some embodiments, the packaged units can be included in one or more clusters. Each of the clusters can have different operating condition and/or operating patterns from one another, for example, due to obstruction (e.g., a wall, a building, or the like) altering flow of the ambient fluid. As such, multiple heat/cool maps and/or hot/cold spots can be determined for the clusters, respectively, and embodiments disclosed herein can be applicable to each cluster. It is further appreciated that the CFD simulation can provide guidelines on unit spacing in response to e.g., wind direction, velocity/speed, or the like.

In the illustrated examples of FIGS. 5-7, the array 300 is in a cooling mode releasing thermal energy into the environment, heating the ambient fluid flowing over the array 300. A wind can blow from south (i.e., bottom of the page) to north (i.e., top of the page) moving outdoor air flowing over the array 300 and removing thermal energy from the array 300. Depending on the locations of the packaged units in the array that are adjusted, the temperature distribution of the ambient fluid over the array 300 can change. For example, in a cooling mode, removing extreme hot spots in the ambient fluid over the array 300 can increase efficiency of the array 300. As shown in the CFDs of FIGS. 5-7, darker gray indicates a higher temperature, and lighter gray indicates a lower temperature.

As shown in FIG. 5, when the locations 510 have an extreme hot spot over the array in FIG. 5, the packaged units at 500 can be turned off. The extreme hot spot 510 can be a result of larger clusters of upstream packaged units releasing heat into the ambient fluid. As shown in FIG. 6, instead of having the packaged units at 500 off as in FIG. 5, the packaged units at 600 are turned off, lowering the temperature at location 610 slightly. As packaged units are generally configured to operate more or most efficiency within a temperature range, raising the temperature at location 620 can still maintain the efficiency at location 620 but cannot improve the efficiency of the packaged units at 610. As shown in FIG. 7, instead of leaving off the packaged units at 500 in FIG. 5 or 600 in FIG. 6, the packaged units at 700 are turned off. The packaged units 700 can be a center column of the packaged units within in array 300. In some embodiments, the direction of columns can be the same direction of flow of the ambient fluid (e.g., wind direction). As shown in FIG. 7, by turning off the packaged units at 700, the temperature at or around 710 are further lowered, for example, compared to the location 610 in FIG. 6 and location 610 in FIG. 5. Accordingly, turning off the packaged units 200 at location 710 can be more effective compared to turning off the packaged units at locations of 510 and/or 610, increasing the efficiency of the array 300.

Embodiments disclosed herein can determine distribution of the wind and/or temperature around the packaged units, to actively, intelligently, and/or selectively shut down a preferred or selected bank of packaged units that are not needed and/or redundant and that get more hot (or cold) air than others, depending on wind conditions such as how the wind is blowing (direction and velocity) and/or weather conditions such as ambient temperature, to provide an overall higher efficiency for the site. It will be appreciated that shutting down packaged units can alter or change the temperature distribution around the packaged units.

Embodiments disclosed herein can optimize the packaged units array for a given weather conditions, strategically control large array of packaged units, and use the lowest or least amount of energy (for a given condition) possible to run the appropriate packaged units in the array. Embodiments disclosed herein can determine the size, number, and/or location of subarray of packaged units to be shut down based on the condition of the wind, the condition of the temperature (e.g., local entering temperature of each packaged unit), and the condition of the array (shape, size, and/or orientation), to provide overall higher efficiency for the site and to improve energy efficiency.

Embodiments disclosed herein can increase efficiency of the array under moderate ambient fluid condition, such as, intermediate wind speed over the array. Such efficiency gain is a result from unexpected results obtained during the experiments for chillers array. Typically, worst cases of efficiency of the packaged units array may be in conditions such as lowest wind speed (e.g., for heat pumps or the like) or highest wind speed. However, experiments show unexpected results for chillers arrays, where intermediate wind speed actually causes hot/cold spot issues. For example, at a wind speed lower than a first threshold level, heat released from the array rises with the heated air, leaving the array. At a wind speed higher than a second threshold level (that is higher than the first threshold level), heated or cooled (e.g., by heat pumps) air is quickly dissipated by the wind, avoiding the creation of hot spots over some downstream units. However, at an intermediate wind speed (higher than the first threshold level but lower than the second threshold level), heat transfer from upstream units can be dissipated at relatively slower rate (e.g., than the wind speed that is higher than a second threshold level). The heating or cooling effect to the ambient fluid accumulate along the direction of the wind and creates hot or cool spots. By eliminating or reducing hot or cool spots in the array, the overall efficiency of the array can be improved. For example, an intermediate wind speed can be a wind speed between the first and second threshold levels.

Aspects

It is appreciated that any one of aspects 1-9 and any one of aspects 10-20 can be combined with each other.

Aspect 1. A heating, ventilation, air conditioning, and refrigeration (HVACR) system, comprising:

an array of packaged units; and a controller configured to:

obtain an operating condition of the array of packaged units, derive the operating condition to construct an operating pattern, select one or more packaged units to be adjusted to increase efficiency of the array of packaged units based on the operating pattern, and adjust operation of the one or more packaged units selected by the controller.

Aspect 2. The HVACR system of aspect 1, wherein the operating condition comprises an entering temperature of at least one packaged units of the array of packaged units.

Aspect 3. The HVACR system of any one of aspect 1 or aspect 2, wherein
the operating condition comprises a coil temperature of at least one packaged units of the array of packaged units.

Aspect 4. The HVACR system of any one of aspects 1-3, wherein the array of packaged units comprises:
one or more upstream units creating an exhaust to affect a temperature of the ambient fluid, and
one or more downstream units receiving the ambient fluid that decreases an efficiency of the one or more downstream units.

Aspect 5. The HVACR system of any one of aspects 1-4, wherein the operating condition comprises:
a shape of the array,
a size of the array,
a spacing between the packaged units, or
an orientation of the array.

Aspect 6. The HVACR system of any one of aspects 1-5, wherein the operating pattern comprises:
a heat map,
a wind speed,
an ambient temperature, or
a wind direction.

Aspect 7. The HVACR system of any one of aspects 1-6, wherein
the controller is configured to adjust by turning off the one or more packaged units of the array of packaged units.

Aspect 8. The HVACR system of any one of aspects 1-7, wherein
the array of packaged units includes one or more redundant packaged units, and
adjusting the one or more of the array of packaged units further comprises turning on at least one of the one or more redundant unit.

Aspect 9. The HVACR system of any one of aspects 1-8, wherein
the array of packaged units is an array of air-cooled chillers.

Aspect 10. A method of operating a heating, ventilation, air conditioning, and refrigeration (HVACR) system, comprising:
obtaining an operating condition of an array of packaged units;
deriving the operating condition to construct an operating pattern;
selecting one or more packaged units in the array of packaged units to be adjusted to increase efficiency based on the operating pattern; and
adjusting operation of the one or more packaged units selected by the controller.

Aspect 11. The method of operating the HVACR system of aspect 10, wherein
the operating condition comprises an entering temperature of at least one packaged unit of the array of packaged units.

Aspect 12. The method of operating the HVACR system of any one of aspect 10 or aspect 11, wherein
the operating condition comprises a coil temperature of at least one packaged unit of the array of packaged units.

Aspect 13. The method of operating the HVACR system of any one of aspect 10-12, wherein
the operating condition comprises a conditioning load required by a conditioned space conditioned by the array of packaged units.

Aspect 14. The method of operating the HVACR system of any one of aspect 10-13, wherein the operating condition comprises:
a shape of the array,
a size of the array,
a spacing between the packaged units, or
an orientation of the array.

Aspect 15. The method of operating the HVACR system of any one of aspect 10-14, wherein the operating pattern comprises:
a heat map,
a wind speed,
a wind direction, or
an ambient temperature.

Aspect 16. The method of operating the HVACR system of any one of aspect 10-15, wherein
adjusting the one or more of the array of packaged units comprises turning off the one or more of the array of packaged units.

Aspect 17. The method of operating the HVACR system of any one of aspect 10-16, wherein
determining the one or more packaged units of the array of packaged units comprises selecting a pattern of one or more packaged units from a set of predetermined patterns of packaged units to be adjusted, wherein
the pattern is selected based on the operating condition or the operating pattern.

Aspect 18. The method of operating the HVACR system of any one of aspect 10-17, wherein
the array of packaged units includes one or more redundant packaged units, and
adjusting the one or more of the array of packaged units further comprises turning on at least one of the one or more redundant unit.

Aspect 19. The method of operating the HVACR system of aspect 15, wherein the heat map is constructed from an entering temperature of one or more packaged units of the array of packaged units.

The terminology used in this specification is intended to describe particular embodiments and is not intended to be limiting. The terms "a," "an," and "the" include the plural forms as well, unless clearly indicated otherwise. The terms "comprises" and/or "comprising," when used in this specification, specify the presence of the stated features, integers, steps, operations, elements, and/or components, but do not preclude the presence or addition of one or more other features, integers, steps, operations, elements, and/or components.

With regard to the preceding description, it is to be understood that changes may be made in detail, especially in matters of the construction materials employed and the shape, size, and arrangement of parts without departing from the scope of the present disclosure. This specification and the embodiments described are exemplary only, with the true scope and spirit of the disclosure being indicated by the claims that follow.

What is claimed is:

1. A heating, ventilation, air conditioning, and refrigeration HVACR) system, comprising:
an array of packaged units, the packaged units being outdoor units; and
a controller configured to:
obtain an operating condition of the array of packaged units,
derive an operating pattern from the operating condition, the operating pattern including a heat map, select one or more packaged units to be adjusted to increase efficiency of the array of packaged units based on the operating pattern, and adjust operation of the one or more packaged units selected by the controller, wherein the operating condition includes a shape of the array, a size of the array, a spacing between the packaged units, and an orientation of the array.

2. The HVACR system of claim 1, wherein the operating condition comprises an entering temperature or a coil temperature of at least one packaged unit of the array of packaged units.

3. The HVACR system of claim 1, wherein the array of packaged units comprises:

one or more upstream units creating an exhaust to affect a temperature of ambient fluid, and one or more downstream units receiving the ambient fluid that decreases an efficiency of the one or more downstream units.

4. The HVACR system of claim 1, wherein the operating pattern further comprises:

a wind speed, an ambient temperature, or a wind direction.

5. The HVACR system of claim 1, wherein the controller is configured to adjust by turning off the one or more packaged units of the array of packaged units.

6. The HVACR system of claim 1, wherein the array of packaged units includes one or more redundant packaged units, and adjusting the one or more packaged units further comprises turning on at least one of the one or more redundant packaged units.

7. The HVACR system of claim 1, wherein the array of packaged units is an array of air-cooled chillers.

8. The HVACR system of claim 1, wherein the one or more packaged units are adjusted to lessen an ambient temperature hot spot or cold spot in the heat map derived from the operating condition.

9. The HVACR system of claim 8, wherein the hot spot or cold spot is caused by a wind speed greater than a first threshold and less than a second threshold.

10. The HVACR system of claim 1, further comprising:

a separator enclosing each of the array of packaged units.

11. The HVACR system of claim 10, wherein the separator has a flat surface extending at a level of a fan deck of the array of packaged units.

12. The HVACR system of claim 11, wherein the separator includes through holes.

13. A method of operating a heating, ventilation, air conditioning, and refrigeration (HVACR) system, comprising:

obtaining an operating condition of an array of packaged units, the packaged units being outdoor units;

deriving an operating pattern from the operating condition, the operating pattern including a heat map;

determining one or more packaged units in the array of packaged units to be adjusted to increase efficiency based on the operating pattern; and adjusting operation of the one or more packaged units selected by the controller, wherein the operating condition includes a shape of the array, a size of the array, a spacing between the packaged units, and an orientation of the array.

14. The method of operating the HVACR system of claim 13, wherein the operating condition comprises an entering temperature or a coil temperature of at least one packaged unit of the array of packaged units.

15. The method of operating the HVACR system of claim 13, wherein the operating condition comprises a conditioning load required by a conditioned space conditioned by the array of packaged units.

16. The method of operating the HVACR system of claim 13, wherein the operating pattern further comprises:

a wind speed, a wind direction, or an ambient temperature.

17. The method of operating the HVACR system of claim 13, wherein the heat map is constructed from an entering temperature of one or more packaged units of the array of packaged units.

18. The method of operating the HVACR system of claim 13, wherein adjusting the one or more packaged units comprises turning off the one or more packaged units.

19. The method of operating the HVACR system of claim 13, wherein determining the one or more packaged units in the array of packaged units comprises selecting a pattern of one or more packaged units from a set of predetermined patterns of packaged units to be adjusted, wherein the pattern is selected based on the operating condition or the operating pattern.

20. The method of operating the HVACR system of claim 13, wherein the array of packaged units includes one or more redundant packaged units, and adjusting the one or more packaged units further comprises turning on at least one of the one or more redundant packaged units.

* * * * *